US008864283B1

(12) United States Patent
Taylor et al.

(10) Patent No.: US 8,864,283 B1
(45) Date of Patent: Oct. 21, 2014

(54) SYSTEM AND METHOD FOR VISUALLY DETECTING DEFECTIVE INKJETS IN AN INKJET IMAGING APPARATUS

(71) Applicant: Xerox Corporation, Norwalk, CT (US)

(72) Inventors: Douglas R. Taylor, Webster, NY (US); Robert E. Rosdahl, Jr., Ontario, NY (US); Brian R. Conrow, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 9 days.

(21) Appl. No.: 13/890,790

(22) Filed: May 9, 2013

(51) Int. Cl.
*B41J 29/393* (2006.01)
*B41J 2/21* (2006.01)

(52) U.S. Cl.
CPC ..... *B41J 2/2142* (2013.01)
USPC ..... 347/19

(58) Field of Classification Search
USPC ..... 347/19, 20; 324/76.11; 73/312; 358/406, 504
See application file for complete search history.

(56) References Cited

U.S. PATENT DOCUMENTS

| | | | | |
|---|---|---|---|---|
| 5,363,134 | A * | 11/1994 | Barbehenn et al. | 347/19 |
| 5,504,507 | A * | 4/1996 | Watrobski et al. | 347/19 |
| 5,736,997 | A * | 4/1998 | Bolash et al. | 347/19 |
| 6,089,693 | A | 7/2000 | Drake et al. | |
| 7,815,274 | B2 | 10/2010 | De Waal | |
| 2003/0085940 | A1 | 5/2003 | Yamada | |

* cited by examiner

*Primary Examiner* — Kristal Feggins
(74) *Attorney, Agent, or Firm* — Maginot Moore & Beck LLP

(57) ABSTRACT

A method of printer operation enables visual detection of defective inkjets. The method includes operating inkjets in a predetermined number of printheads that eject a same color of ink to form a test pattern having three portions. One portion is printed by the even-numbered inkjets in each printhead, one portion is printed by the odd-numbered inkjets in each printhead, and a third portion is printed by all of the inkjets in each printhead. The portions are printed immediately adjacent to one another in a process direction with the third portion between the other two portions.

20 Claims, 7 Drawing Sheets

SYSTEM AND METHOD FOR VISUALLY DETECTING DEFECTIVE INKJETS IN AN INKJET IMAGING APPARATUS

TECHNICAL FIELD

The present disclosure relates generally to inkjet imaging apparatus and, more particularly, to the detection of defective inkjets in an inkjet imaging apparatus.

BACKGROUND

Drop on demand inkjet technology for producing printed media has been employed in commercial products such as printers, plotters, and facsimile machines. Generally, an inkjet image is formed by selectively ejecting ink drops onto an image substrate from a plurality of drop generators or inkjets, which are arranged in a printhead or a printhead assembly. For example, the printhead assembly and the image substrate are moved relative to one another and the inkjets are controlled to eject ink drops at appropriate times. The timing of the inkjet activation is performed by a printhead controller, which generates firing signals that selective activate inkjets to eject ink onto an image substrate. The image substrate may be an intermediate image member, such as a print drum or belt, from which the ink image is later transferred to a print medium, such as paper. The image substrate may also be a moving web of print medium or sheets of a print medium onto which the ink drops are directly ejected. The ink ejected from the inkjets may be liquid ink, such as aqueous, solvent, oil based, UV curable ink or the like, which is stored in containers installed in the printer. Alternatively, the ink may be loaded in a solid form and delivered to a melting device, which heats the solid ink to its melting temperature to generate liquid ink, which is supplied to a printhead.

During the operational life of an inkjet printer, inkjets in one or more of the printheads may become unable to eject ink in response to receiving a firing signal. The defective condition of the inkjet may temporarily persist so the inkjet becomes operational after one or more image printing cycles. In other cases, the inkjet may remain unable to eject ink until a purge cycle is performed. A purge cycle may successfully unclog inkjets so that they are able to eject ink once again. Execution of a purge cycle, however, requires the imaging apparatus to be taken out of its image generating mode. Thus, purge cycles affect the throughput rate of an imaging apparatus and are preferably performed during downtime.

In previously known imaging devices, a controller operated printheads to print a test pattern onto an image substrate. The test pattern was scanned with an optical sensor, which generated image data corresponding to the intensity of the light reflected by the bare image substrate and the ink on the image substrate. These image data are processed by the controller to identify the positions of the ink on the image substrate and from this positional information the controller can detect defective inkjets as well as printhead position data that can be used to adjust or compensate for erroneous printhead positions. This printer process, however, is sometimes unable to detect defective inkjets. In one situation that is problematic, an inkjet is able to print a sequence of drops to form a dash in a test pattern, but during printing operations, especially during the printing of high density coverage areas, the inkjet fails to eject ink. Consequently, these inkjets are not detected as being defective and no compensation technique is enabled to mask the inability of these inkjets to eject ink properly. Methods to detect sporadic inkjets reliably would be useful.

SUMMARY

A new method enables visual detection of defective inkjets in an image generating device. The method comprises operating with a controller a substantially evenly-distributed subset of inkjets in each printhead in a first predetermined number of printheads that eject ink having a same first ink color to form a first portion of a test pattern on an image substrate, operating with the controller substantially every inkjet in each printhead in the first predetermined number of printheads that eject ink having the same first ink color to form a second portion of the test pattern on the image substrate that is immediately adjacent to the first portion of the test pattern in a process direction, operating with the controller the inkjets in each printhead in the first predetermined number of printheads that were not used to form the first portion of the test pattern to form a third portion of the test pattern on the image substrate that is immediately adjacent to the second portion of the test pattern, and moving the image substrate on which the test pattern is printed to a position where the test pattern on the image substrate can be viewed by a user.

A printing system implements the new method that enables defective inkjets to be visually detected. The printing system includes a plurality of printheads, a first predetermined number of printheads in the plurality of printheads being configured to eject ink of a first color and a second predetermined number of printheads in the plurality of printheads being configured to eject ink of a second color, a media transport configured to move media past the plurality of printheads in a process direction to enable ink to be ejected onto the media, and a controller operatively connected to the plurality of printheads and the media transport. The controller is configured to: operate a substantially evenly-distributed subset of inkjets in each printhead in the first predetermined number of printheads to form a first portion of a test pattern on media moving past the plurality of printheads, operate substantially every inkjet in each printhead in the first predetermined number of printheads to form a second portion of the test pattern on the media that is immediately adjacent in the process direction to the first portion of the test pattern, operate with the controller the inkjets in each printhead in the first predetermined number of printheads that were not used to form the first portion of the test pattern to form a third portion of the test pattern on the media that is immediately adjacent to the second portion of the test pattern in the process direction, and operate the media transport to move the media on which the test pattern is printed to a position where the test pattern on the image substrate can be viewed by a user.

BRIEF DESCRIPTION OF THE DRAWINGS

The foregoing aspects and other features of an inkjet printing apparatus, which enables visually detection of defective inkjets in a printhead are explained in the following description, taken in connection with the accompanying drawings.

DETAILED DESCRIPTION

Figure 1:
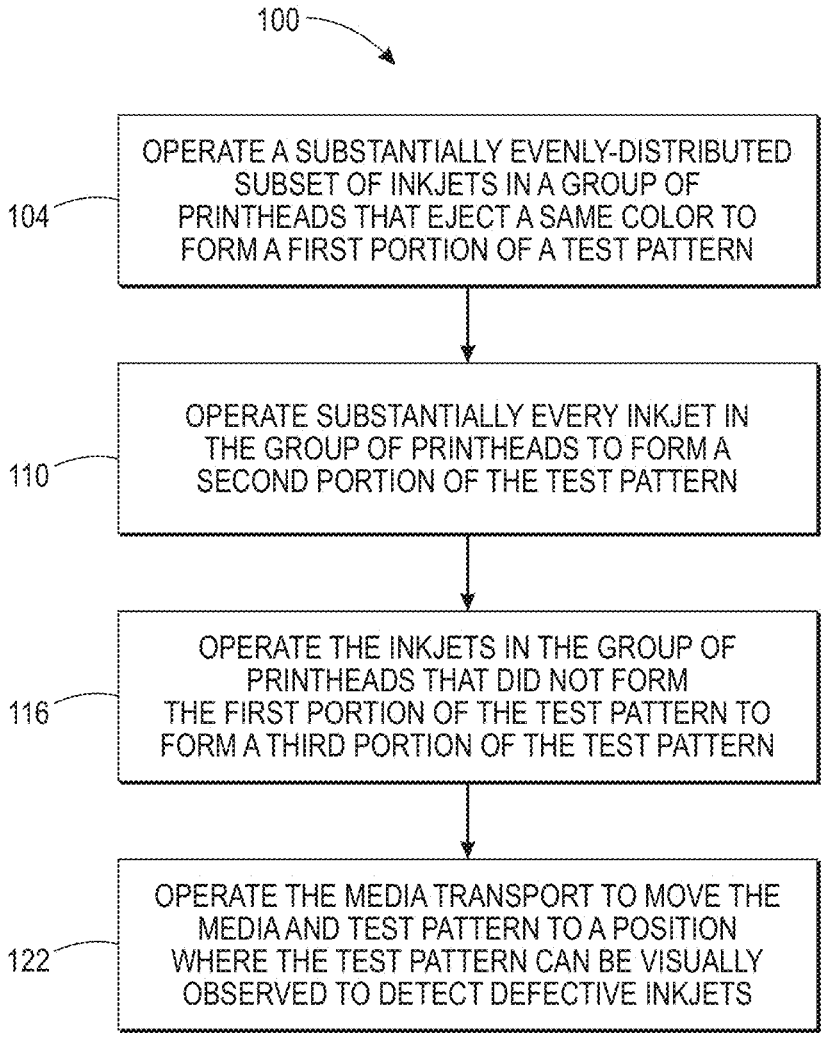
FIG. 1 is a flow diagram of a process for producing a test pattern that enables visual detection of defective inkjets.

For a general understanding of the environment for the system and method disclosed herein and the details for the system and method, reference is made to the drawings. In the drawings, like reference numerals have been used throughout to designate like elements. As used herein, the words "printer" and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by a subsequent printer.

FIG. 8 depicts an imaging apparatus 5 that uses the method described in this document to enable visual detection of missing, intermittent, or weak inkjets. The imaging apparatus 5 can implement a solid ink print process for printing onto a continuous media web. Although the system and method disclosed herein is most beneficial in imaging apparatus in which the recording media passes the printheads only once, the system and method may also be used in imaging apparatus in which multiple passes occur to form an image. Furthermore, while the system and method are discussed in the context of a solid ink imaging apparatus, they can be used with imaging apparatus that use other types of liquid ink, such as aqueous, emulsified, gel, UV curable inks, or inks having magnetic properties such as those used in magnetic ink character recognitions systems ("MICR"). Therefore, the system and method can be used in any imaging apparatus that provides liquid ink to one or more printheads, including cartridge inkjet systems.

The imaging apparatus 5 shown in FIG. 8 forms a printed image on media by ejecting ink droplets from a plurality of inkjets arranged in one or more printheads. During the course of printing, one or more of the inkjets may become unavailable to eject ink. The system described herein implements a method of defective inkjet detection, which enables a user to detect defective inkjets in high density coverage areas and identify the defective inkjets through a user interface to enable a controller in the printer to compensate for the defective inkjets. For example, a functional inkjet, referred to as a compensating inkjet, can be used to eject ink in place of an identified defective inkjet. Once the defective inkjets are identified through the user interface, they are deactivated by a printer controller and no longer used for printing until a maintenance operation is performed, which may rehabilitate the defective inkjets.

The imaging apparatus 5 includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The direct-to-sheet, continuous-media, phase-change inkjet imaging apparatus 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging apparatus. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of the system 5 is discussed in more detail with reference to FIG. 9 below.

The imaging apparatus may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. Following the mid-heaters 30, a fixing assembly 40 is configured to apply heat and/or pressure to the media to fix the images to the media. The term "fixing" may refer to the stabilization of ink on media through components operating on the ink and/or the media, including, but not limited to, fixing rollers and the like. In the embodiment of the FIG. 8, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. The spreader 40 includes rollers, such as image-side roller 42 and pressure roller 44, to apply heat and pressure to the media. Either roller can include heat elements, such as heating elements 46, to bring the web W to a temperature in a range from about 35° C. to about 80° C.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant.

Following passage through the spreader 40, the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the printheads of color modules 21A-21D in order to operate the printheads to form the test patterns with indicia described below to enable visual detection of defective inkjets.

The imaging apparatus 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors/sensors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

A schematic view of a prior art print zone 900 that may be used in the imaging apparatus 5 is depicted in FIG. 9. The printheads of this print zone can be operated as described below to print a test pattern with indicia that enables visual detection of defective inkjets. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as it travels under the color unit from color unit 924 to color unit 912. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

A method for operating inkjets in a plurality of printheads in a printer to enable visual detection of one or more defective inkjets is shown in FIG. 1. In the description of the method, a statement that the process does some function or performs some action refers to a controller executing programmed instructions to do the function or perform the action or to the controller generating signals to operate one or more electrical or electromechanical components to perform the function or action. The process 100 begins with the controller operating a substantially evenly-distributed subset of inkjets in each printhead in a first predetermined number of printheads that eject ink having a same first ink color to form a first portion of a test pattern on an image substrate (block 104). The term "substantially evenly-distributed subset of inkjets" means a group of inkjets having approximately the same predetermined distance between them and the inkjets in the group having at least one non-firing inkjet between them. For example, every other inkjet in a printhead would be a substantially evenly-distributed subset of inkjets in a printhead. In one embodiment, the seven printheads of print bar array 936 in the color unit 924 shown in FIG. 9 correspond to the first predetermined number of printheads ejecting the same color of ink. These printheads form the portion 204 of test pattern 200 shown in FIG. 2. This portion is formed by operating the even-numbered inkjets in the printheads M11, M12, M13, M14, M21, M22, and M23.

The process 100 in FIG. 1 continues by the controller operating essentially every inkjet in each printhead in the first predetermined number of printheads that eject ink having the same first ink color to form a second portion of the test pattern on the image substrate that is immediately adjacent to the first portion of the test pattern in a process direction (block 110). In the embodiment discussed above, the inkjets in the seven printheads of print bar array 936 in the color unit 924 shown in FIG. 9 are operated to form the portion 210 of test pattern 200 shown in FIG. 2. This portion is formed by operating all of the inkjets in the printheads M11, M12, M13, M14, M21, M22, and M23. Process 100 then continues by the controller operating the inkjets in each printhead in the first predetermined number of printheads that were not used to form the first portion of the test pattern to form a third portion of the test pattern on the image substrate that is immediately adjacent to the second portion of the test pattern (block 116). In the embodiment being discussed, the odd-numbered inkjets in the seven printheads of print bar array 936 in the color unit 924 shown in FIG. 9 are operated to form the portion 216 of test pattern 200 shown in FIG. 2. The controller can operate the media transport carrying the media through the print zone to a position where a user can observe the test pattern on the media to inspect the media visually and detect missing inkjets (block 122).

Figure 2:
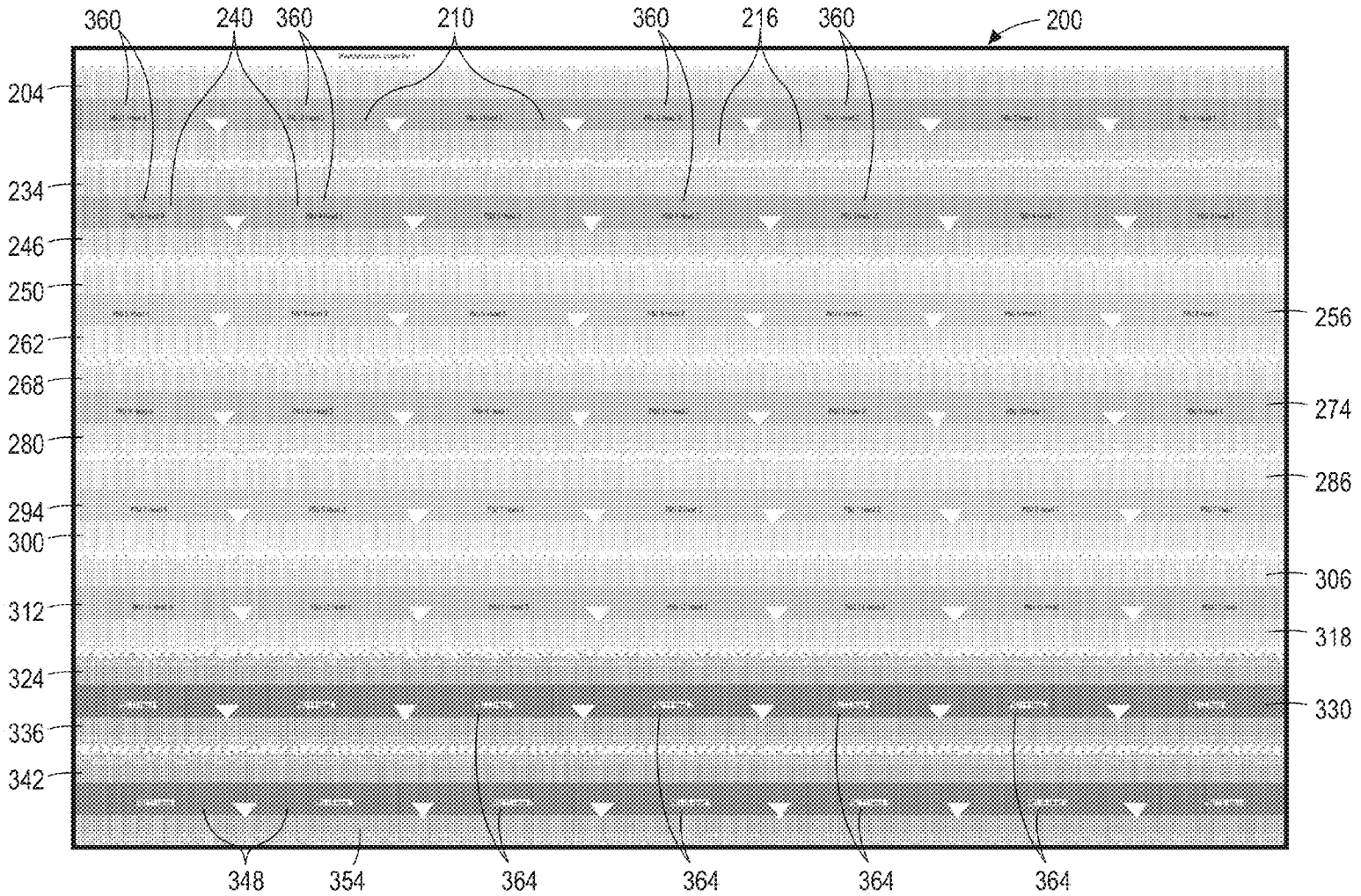
FIG. 2 illustrates a test pattern printed to enable visual detection of defective inkjets in a printer having a printhead arrangement as shown in FIG. 7.

By operating the printheads for each print bar array in this manner, the test pattern shown in FIG. 2 is produced. Specifically, test portions 234, 240 and 246 are printed by the printheads of print bar array 938. Likewise, test portions 250, 256 and 262 are printed by the printheads of the upper print bar array in the cyan color unit 920 in FIG. 9, while the test portions 286, 294, and 300 are printed by the printheads of the lower print bar array in the cyan color unit 920. Similarly, test portions 324, 330 and 336 are printed by the printheads of the upper print bar array in the black color unit 912 in FIG. 9, while the test portions 342, 348, and 354 are printed by the printheads of the lower print bar array in the black color unit 912.

Figure 3:
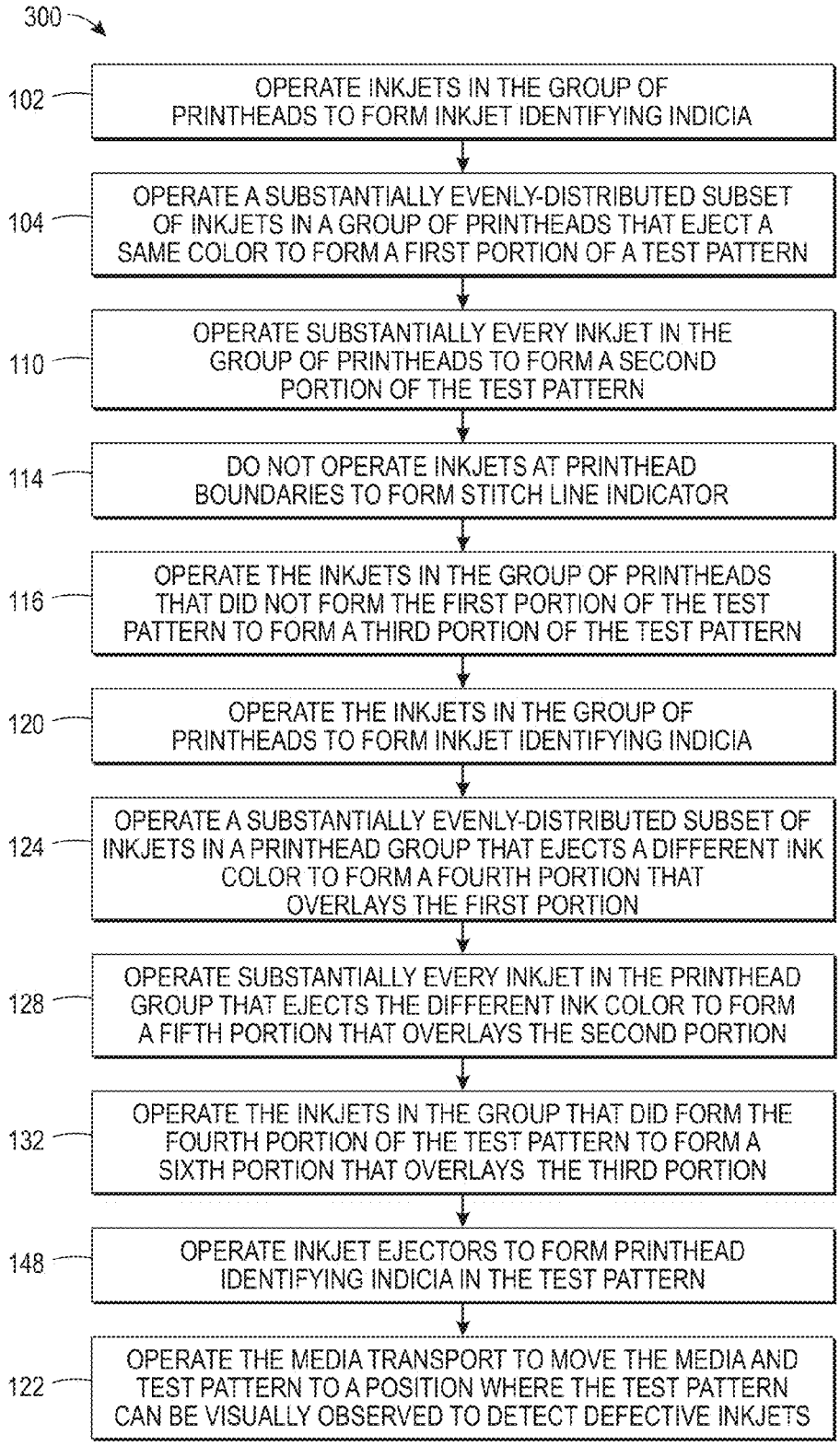
FIG. 3 is a flow diagram of another process for producing a test pattern that enables visual detection of defective inkjets.

The process 100 of FIG. 1 can be augmented with additional processing shown in the process of FIG. 3. Using like numbers for like processing, process 300 operates as described above for the processing described above with reference to blocks 104, 110, 116 and 122. Additionally, the controller operates inkjets in the first predetermined number of printheads to form indicia identifying inkjet position in each printhead in the first predetermined number of printheads (block 106). Each inkjet in each printhead is used to print the indicia, which identifies the inkjet. Consequently, indicia missing from the test pattern 200 aids in detecting defective inkjets. These indicia can be printed either before the first portion of the test pattern for a print bar array is printed or after the third portion of the test pattern for the print bar array is printed. In one embodiment, shown in FIG. 3, the controller also operates the inkjets in the first predetermined number of printheads to form inkjet identifying indicia after operating the inkjets in the first predetermined number of printheads to form the third portion of the test pattern on the image substrate (block 120). The inkjet identifying indicia formed after the third portion of the test pattern identifies inkjets in the first predetermined number of printheads that are different than the inkjets identified by the inkjet identifying indicia printed before the first portion of the test pattern. In one embodiment, the indicia printed before the first portion identifies even-numbered inkjets, while the indicia printed after the third portion of the test pattern identifies odd-numbered inkjets. An expanded view of a section of portions 204, 210 and 216 is presented in FIG. 4 with the indicia 212 identifying even-numbered inkjets and indicia 218 identifying odd-numbered indicia.

In the process 300, during the formation of the second and third portions of the test pattern printed by the printheads of the print bar array 936, the controller operates the inkjet ejectors in the first predetermined number of printheads to form an indicator of a stitch line between adjacent printheads in a cross-process direction (block 114). A stitch line is a boundary at which one printhead ends in the cross-process direction and the adjacent printhead in the cross-process direction begins. The stitch line is identified by triangle 222 in FIG. 4, which is formed by not operating the inkjets to eject ink in the triangular area. This shape facilitates visual detection of the boundary, while enabling a sufficient number of inkjet ejections in portions 210 and 216 to enable detection of missing inkjets at the boundary of the two adjacent printheads.

Figure 4:
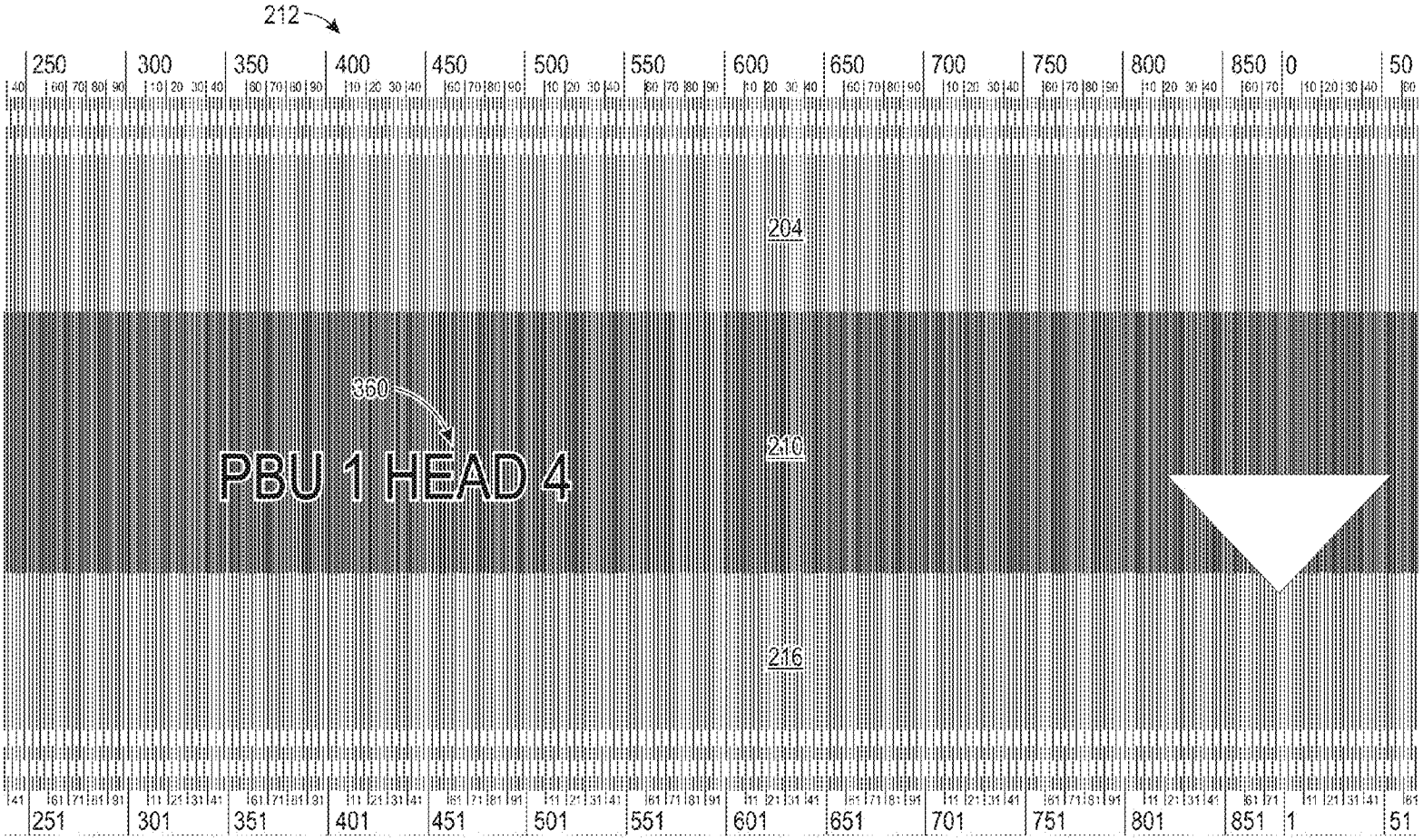
FIG. 4 illustrates an expanded portion of the test pattern shown in FIG. 2.

Test portions 268, 274 and 280 shown in FIG. 4 are printed by the printheads of the upper print bar array in cyan color unit 920 and by the printheads of the upper print bar array in the yellow color unit 916. Similarly, test portions 306, 312 and 318 are printed by the printheads of the lower print bar array in cyan color unit 920 and by the printheads of the lower print bar array in the yellow color unit 916. This overprinting is performed in the processing depicted in blocks 124, 128 and 132 of FIG. 3. Specifically, the processing described in blocks 104, 110 and 116 is performed twice by the printheads of the upper print bar array in the cyan color unit 920 and also twice by the printheads of the lower print bar array in the cyan color unit 920. Then, as the media passes under the yellow color unit 916, a substantially evenly-distributed subset of inkjets in the printheads of the upper print bar array in unit 916 is operated to overlay the first portion of the second cyan test pattern (block 124). Similarly, substantially every inkjet in the printheads of the upper print bar array in unit 916 is operated to overly the second portion of the second cyan test pattern (block 128) and the inkjets not used to form the fourth portion of the test pattern are operated to overlay the third portion of the second cyan test pattern (block 132). These operations are repeated for the printheads of the lower print bar array in unit 916 so fourth, fifth, and sixth portions of a yellow test pattern overlay the first, second and third portions of the fourth cyan test pattern. The yellow ink is printed over the cyan ink to produce the secondary color green. Because yellow presents a low contrast with bare media, the absence of the secondary color in the two green bands facilitates detection of a missing yellow inkjet. Moreover, the green bands are interposed between the cyan bands to enable confirmation that a missing cyan inkjet in the cyan only color band presents a yellow streak in the green color band that follows.

The process 300 also include the controller operating inkjets in a printhead that ejects a color of ink that is different than the color of ink ejected by the first predetermined number of printheads to form indicia identifying each printhead in the first predetermined number of printheads (block 148). The controller can operate the media transport carrying the media through the print zone to a position where a user can observe the test pattern on the media to inspect the media visually and detect missing inkjets (block 122). In one embodiment, the printheads ejecting black ink are used to generate printhead identifying indicia 360 for the test patterns printed by the color units 924, 920 and 916, while the printing of the test pattern portions with black ink is operated to not eject black ink to form the printhead identifying indicia 364 as shown in FIG. 2. While the test pattern of FIG. 2 depicts the printhead identifying indicia in the second portions of the test pattern printed by the various print bar arrays, these indicia can be printed in other portions as well. As depicted in FIG. 4, the printhead identifying indicia includes a print bar array (PBU) number and a printhead number, although identifying indicia could be used.

Figure 5:
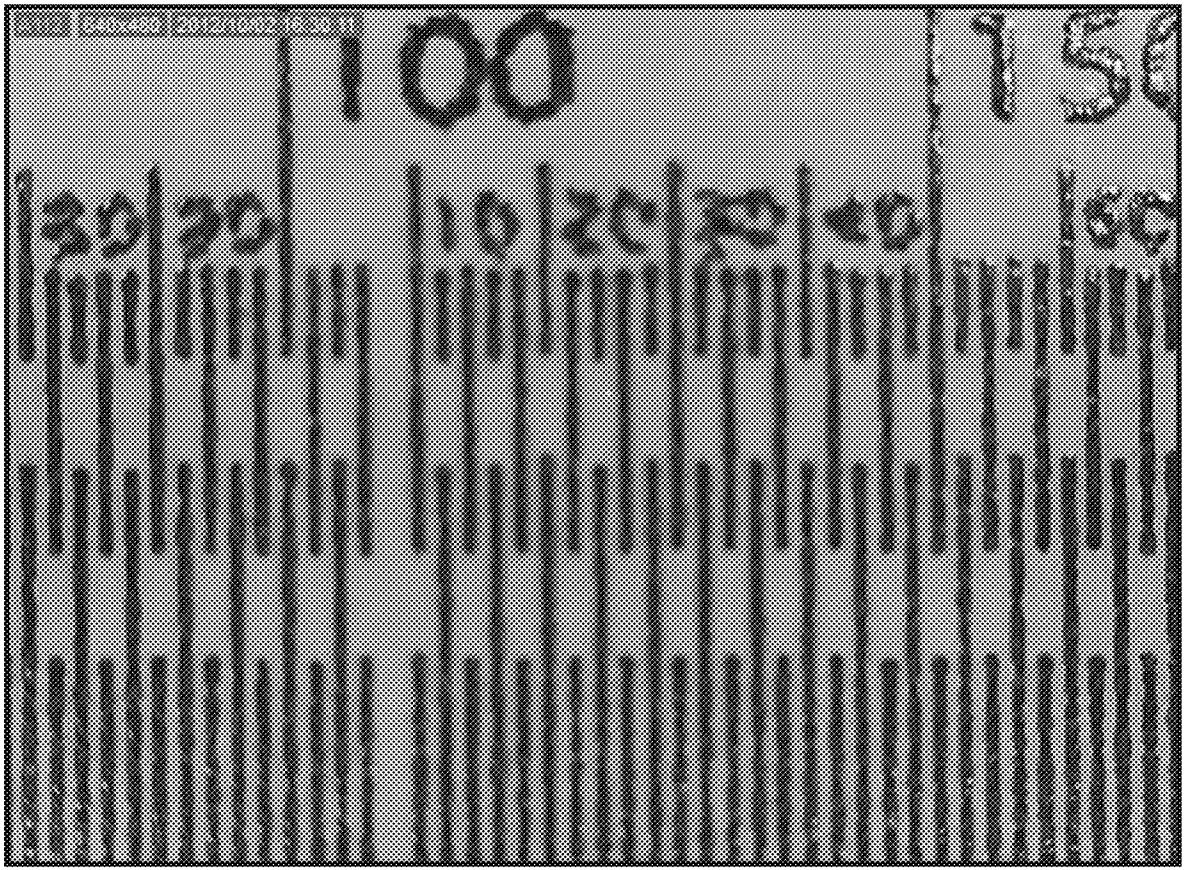
FIG. 5 illustrates a magnified portion of the test pattern shown in FIG. 2.

For purposes of illustration, a magnified view of the inkjet indicia and test pattern portion 324 is shown in FIG. 5. There, the black ink is ejected to form indicia lines and identifying numbers. From this depiction, ink ejected by inkjet 108 is clearly missing. While the absence of this ink is visually perceptible to an unaided eye, use of a magnifying instrument aids in a positive identification of the defective inkjet.

Figure 6:
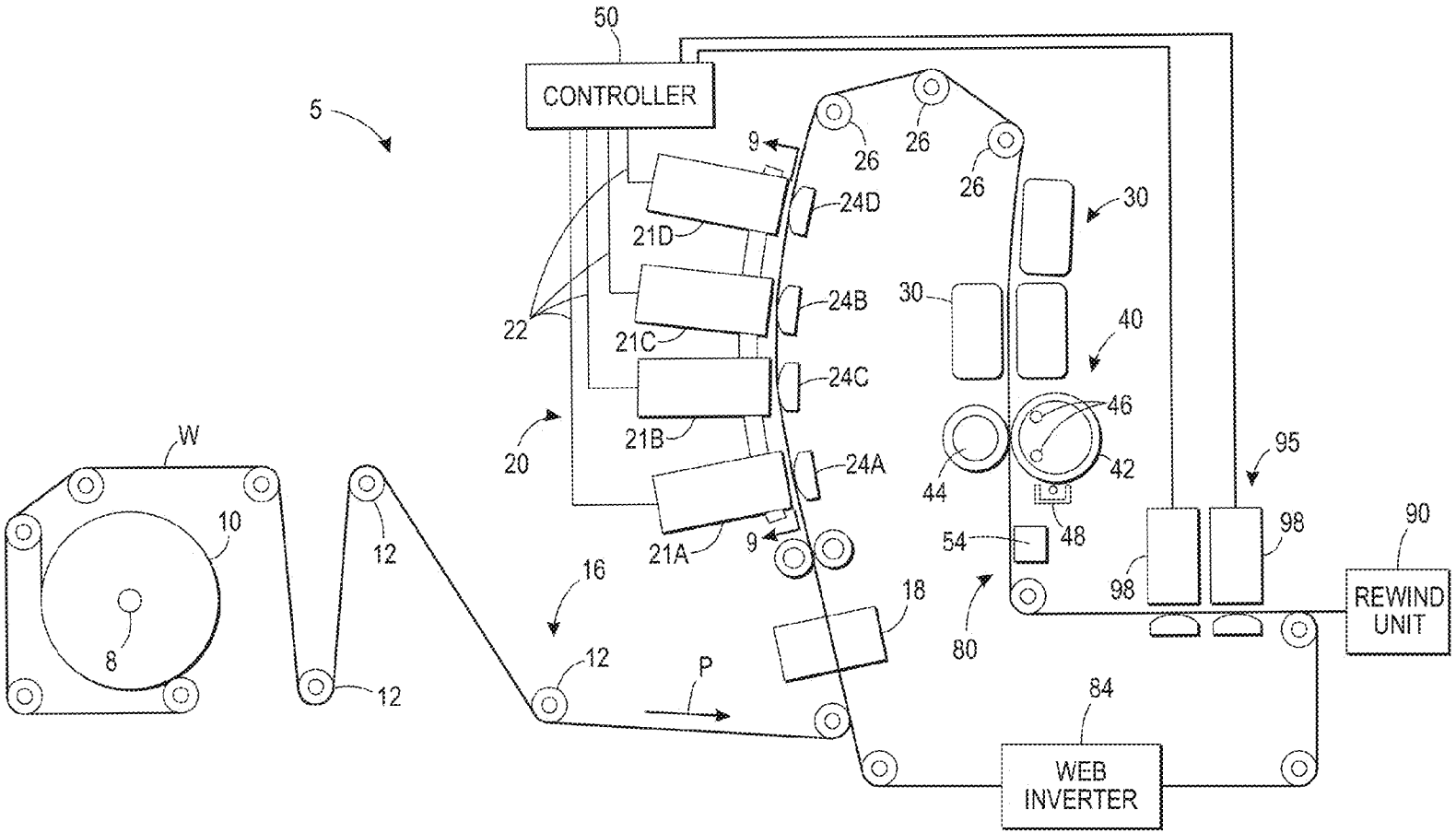
FIG. 6 illustrates a block diagram of a prior art inkjet printing apparatus in which a system and method that enables visual detection of defective inkjet ejectors can be used.
Figure 7:
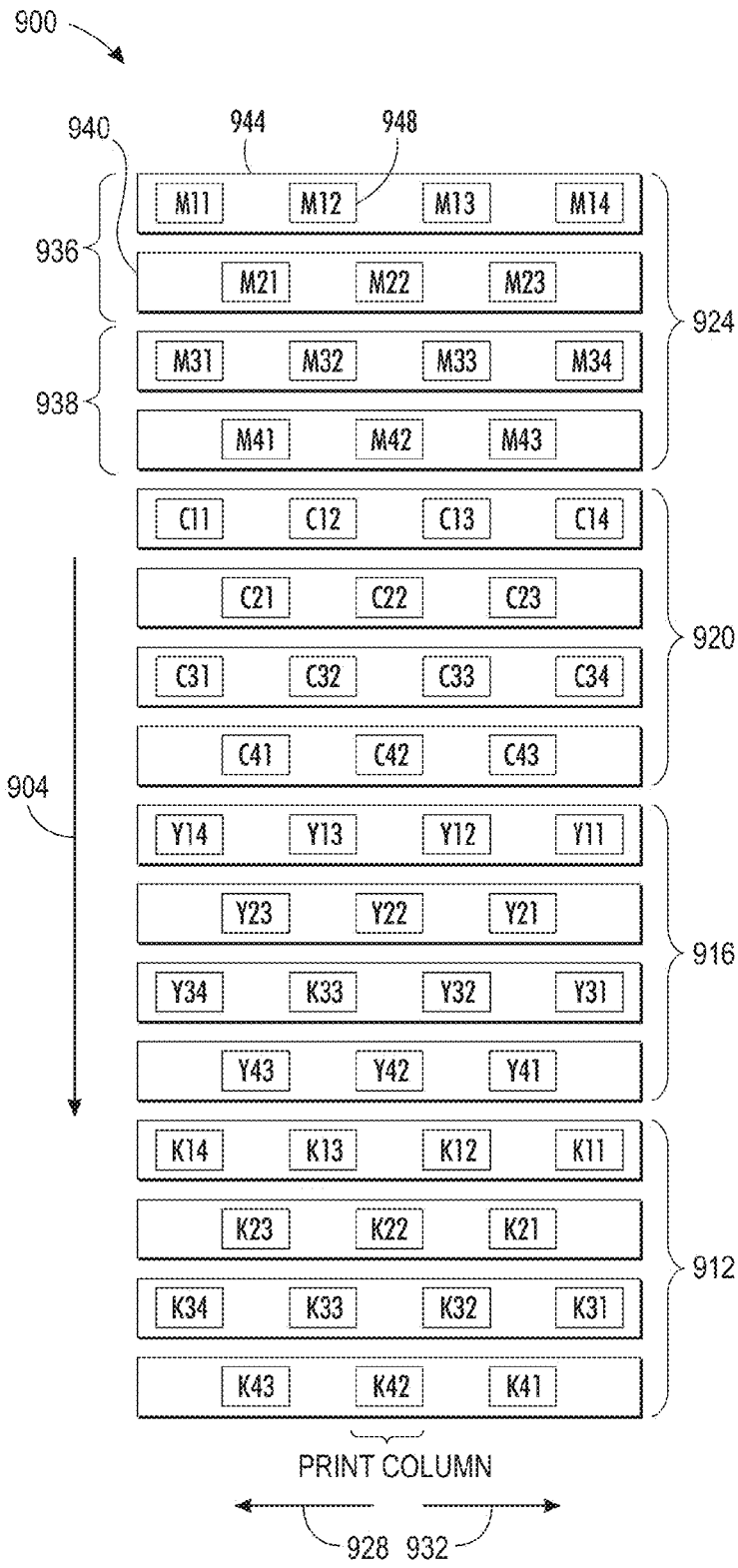
FIG. 7 PRIOR ART
FIG. 7 illustrates a schematic view of a prior art printhead configuration viewed along lines 9-9 in FIG. 6.

The methods disclosed herein may be implemented by a processor being configured with instructions and related circuitry to perform the methods. Additionally, processor instructions may be stored on computer readable medium so they may accessed and executed by a computer to perform the methods for printing test patterns with indicia that enable visual detection of defective inkjets. Accordingly, storing such instructions on computer readable media within the printer shown in FIG. 6 to configure one or more controllers in the printer to perform the methods described above takes that printer out of the prior art. Such a printer would then be configured to print the test patterns shown in FIG. 2, FIG. 4, and FIG. 5 and move the media and test pattern to a position where a user could view them for detection of defective inkjets.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating inkjets in a plurality of printheads in a printer to enable visual detection of one or more defective inkjets comprising:

operating with a controller a substantially evenly-distributed subset of inkjets in each printhead in a first predetermined number of printheads that eject ink having a same first ink color to form a first portion of a test pattern on an image substrate;

operating with the controller substantially every inkjet in each printhead in the first predetermined number of printheads that eject ink having the same first ink color to form a second portion of the test pattern on the image substrate that is immediately adjacent to the first portion of the test pattern in a process direction;

operating with the controller the inkjets in each printhead in the first predetermined number of printheads that were not used to form the first portion of the test pattern to form a third portion of the test pattern on the image substrate that is immediately adjacent to the second portion of the test pattern; and moving the image substrate on which the test pattern is printed to a position where the test pattern on the image substrate can be viewed by a user.

2. The method of inkjet operation in claim 1 further comprising:

operating with the controller inkjets in the first predetermined number of printheads to form indicia identifying nozzle position in each printhead in the first predetermined number of printheads that eject the same color of ink, each nozzle in each printhead being used to print the indicia identifying the nozzle itself.

3. The method of claim 2 further comprising:

operating the inkjets in the first predetermined number of printheads to form the nozzle identifying indicia before operating the inkjets in the first predetermined number of printheads that eject the same color of ink to form the first portion of the test pattern on the image substrate.

4. The method of claim 3 further comprising:

operating with the controller the inkjets in the first predetermined number of printheads to form nozzle identifying indicia after operating the inkjets in the first predetermined number of printheads that eject the same color of ink to form the third portion of the test pattern on the image substrate, the nozzle identifying indicia formed after the third portion of the test pattern identifies nozzles in the first predetermined number of printheads that are different than the nozzles identified by the nozzle identifying indicia printed before the first portion of the test pattern.

5. The method of claim 2 further comprising:

operating the inkjets in the first predetermined number of printheads to form the nozzle identifying indicia after operating the inkjets in the first predetermined number of printheads that eject the same color of ink to form the third portion of the test pattern on the image substrate.

6. The method of claim 1 further comprising:

operating with the controller the inkjet ejectors in the first predetermined number of printheads to form an indicator of a stitch line between adjacent printheads in a cross-process direction.

7. The method of claim 1 further comprising:

operating with the controller inkjets in a printhead that ejects a color of ink that is different than the color of ink ejected by the first predetermined number of printheads that eject the same color of ink to form indicia identifying each printhead in the first predetermined number of printheads.

8. The method of claim 7 further comprising:

operating with the controller the inkjets that form the printhead identifying indicia to form the printhead identifying indicia over the second portion of the test pattern.

9. The method of claim 1 further comprising:

operating with the controller a substantially evenly-distributed subset of inkjets in each printhead in a second predetermined number of printheads that eject ink having a same second ink color that is different than the first ink color ejected by the first predetermined number of printheads, the substantially evenly-distributed subset of inkjets in the second predetermined number of printheads being operated to form a fourth portion of the test pattern that overlays the first portion of the test pattern on the image substrate;

operating with the controller substantially every inkjet in each printhead in the second predetermined number of printheads to form a fifth portion of the test pattern that overlays the second portion of the test pattern on the image substrate; and operating with the controller the inkjets in each printhead in the second predetermined number of printheads that were not used to form the fourth portion of the test pattern to form a sixth portion of the test pattern that overlays the third portion of the test pattern on the image substrate, the first ink color and the second ink color forming a secondary color that enables defective inkjets in the printheads ejecting the second ink color to be detected.

10. The method of claim 9 wherein the first ink color is cyan and the second ink color is yellow.

11. A printing apparatus comprising:

a plurality of printheads, a first predetermined number of printheads in the plurality of printheads being configured to eject ink of a first color and a second predetermined number of printheads in the plurality of printheads being configured to eject ink of a second color;

a media transport configured to move media past the plurality of printheads in a process direction to enable ink to be ejected onto the media; and a controller operatively connected to the plurality of printheads and the media transport, the controller being configured to:

operate a substantially evenly-distributed subset of inkjets in each printhead in the first predetermined number of printheads to form a first portion of a test pattern on media moving past the plurality of printheads;

operate substantially every inkjet in each printhead in the first predetermined number of printheads to form a second portion of the test pattern on the media that is immediately adjacent in the process direction to the first portion of the test pattern;

operate with the controller the inkjets in each printhead in the first predetermined number of printheads that were not used to form the first portion of the test pattern to form a third portion of the test pattern on the media that is immediately adjacent to the second portion of the test pattern in the process direction; and operate the media transport to move the media on which the test pattern is printed to a position where the test pattern on the image substrate can be viewed by a user.

12. The printing apparatus of claim 11, the controller being further configured to:

operate inkjets in the first predetermined number of printheads to form indicia identifying nozzle position in each printhead in the first predetermined number of printheads that eject the same color of ink, each nozzle in each printhead being used to print the indicia identifying the nozzle itself.

13. The printing apparatus of claim 12, the controller being further configured to:

operate the inkjets in the first predetermined number of printheads to form the nozzle identifying indicia before operating the inkjets in the first predetermined number of printheads to form the first portion of the test pattern on the media.

14. The printing apparatus of claim 13, the controller being further configured to:

operate the inkjets in the first predetermined number of printheads to form the nozzle identifying indicia after operating the inkjets in the first predetermined number of printheads to form the third portion of the test pattern on the media, the nozzle identifying indicia formed after the third portion of the test pattern identifies nozzles in the first predetermined number of printheads that are different than the nozzles identified by the nozzle identifying indicia printed before the first portion of the test pattern.

15. The printing apparatus of claim 12, the controller being further configured to:

operate the inkjets in the first predetermined number of printheads to form the nozzle identifying indicia after operating the inkjets in the first predetermined number of printheads to form the third portion of the test pattern on the media.

16. The printing apparatus of claim 11, the controller being further configured to:

operate the inkjet ejectors in the first predetermined number of printheads to form an indicator of a stitch line between adjacent printheads in a cross-process direction.

17. The printing apparatus of claim 11, the controller being further configured to:

operate inkjets in a printhead that ejects a color of ink that is different than the color of ink ejected by the first predetermined number of printheads to form indicia identifying each printhead in the first predetermined number of printheads.

18. The printing apparatus of claim 17, the controller being further configured to:

operate the inkjets that form the printhead identifying indicia to form the printhead identifying indicia over the second portion of the test pattern.

19. The printing apparatus of claim 11, the controller being further configured to:

operate a substantially evenly-distributed subset of inkjets in each printhead in the second predetermined number of printheads that eject ink having a same second ink color that is different than the first ink color ejected by the first predetermined number of printheads, the substantially evenly-distributed subset of inkjets in the second predetermined number of printheads being operated to form a fourth portion of the test pattern that overlays the first portion of the test pattern on the media;

operate substantially every inkjet in each printhead in the second predetermined number of printheads to form a fifth portion of the test pattern that overlays the second portion of the test pattern on the media; and operate the inkjets in each printhead in the second predetermined number of printheads that were not used to form the fourth portion of the test pattern to form a sixth portion of the test pattern that overlays the third portion of the test pattern on the media, the first ink color and the second ink color forming a secondary color that enables defective inkjets in the printheads ejecting the second ink color to be detected.

20. The printing apparatus of claim 19 wherein the first ink color is cyan and the second ink color is yellow.

* * * * *